US005634712A

United States Patent [19]

Musil

[11] Patent Number: 5,634,712

[45] Date of Patent: Jun. 3, 1997

[54] ASPHALT PLANT WITH GAS CONTAINMENT SYSTEM

[75] Inventor: Joseph E. Musil, Ely, Iowa

[73] Assignee: Cedarapids, Inc., Cedar Rapids, Iowa

[21] Appl. No.: 512,769

[22] Filed: Aug. 9, 1995

[51] Int. Cl.[6] ..... B28C 1/22

[52] U.S. Cl. ..... 366/22; 366/25; 432/65; 432/103

[58] Field of Search ..... 366/25, 24, 23, 366/22, 42, 49, 181.1, 181.2, 181.3, 26, 10; 110/203, 264; 432/65, 106, 254.1, 113, 103

[56] References Cited

U.S. PATENT DOCUMENTS

| | | | |
|---|---|---|---|
| 3,106,384 | 10/1963 | Preeman | 366/22 |
| 3,378,171 | 4/1968 | Eaton | 366/22 |
| 3,857,552 | 12/1974 | Ohlson | 366/23 |
| 3,905,587 | 9/1975 | Preeman . | |
| 4,089,508 | 5/1978 | Anderson . | |
| 4,103,350 | 7/1978 | Brock et al. | 366/22 |
| 4,136,964 | 1/1979 | Swisher, Jr. et al. . | |
| 4,190,370 | 2/1980 | Brock et al. . | |
| 4,477,250 | 10/1984 | Brashears et al. | 366/25 |
| 4,579,458 | 4/1986 | Ohlson | 366/23 |
| 4,638,747 | 1/1987 | Brock et al. . | |
| 4,993,839 | 2/1991 | Brock . | |
| 5,209,563 | 5/1993 | Swisher, Jr. et al. . | |
| 5,215,372 | 6/1993 | Milstead | 366/22 |
| 5,251,976 | 10/1993 | Milstead | 366/22 |
| 5,252,124 | 10/1993 | Brashears et al. . | |

FOREIGN PATENT DOCUMENTS

| | | | |
|---|---|---|---|
| 605461 | 9/1960 | Canada | 366/22 |

*Primary Examiner*—Tony G. Soohoo

*Attorney, Agent, or Firm*—Simmons, Perrine, Albright & Ellwood, PLC

[57] ABSTRACT

An asphalt plant is provided with a system for containing noxious and nuisance gases and fumes generated therein. The system includes a substantially air tight casing encircling an slat conveyor of the plant, a substantially air tight elevator chute having a substantially air tight connection to each of a drum dryer/mixer and the casing, a batcher chute having a substantially air tight connection to each of the casing and a batcher of the plant, a substantially air tight seal between the batcher and a silo of the plant, and a bypass duct bypassing the seal between the batcher and the silo such that a negative pressure created in the drum dryer/mixer by a power exhaust of the plant is distributed substantially throughout various components of the plant as the batcher and the silo contain sufficient asphalt material being processed by the plant such that air and other gases and fumes contained within the plant are prevented from escaping directly into the ambient atmosphere.

21 Claims, 1 Drawing Sheet

ASPHALT PLANT WITH GAS CONTAINMENT SYSTEM

BACKGROUND OF THE INVENTION

Asphalt plants and the technologies associated therewith are a necessary component of the various industrial apparatus needed to supply the demands of today's society, including paving for highways, parking lots, and the like. Unfortunately, the ingredients of the materials involved and the high temperatures required to properly process those materials are a source of air borne particles, gaseous substances and vapors that are not only noxious and contaminating, but are the source of odors which can create a substantial nuisance.

By regulation, the contaminating aspects must be reduced below certain levels and various types of apparatus and processes have been developed to meet these requirements. Unfortunately, even as those regulations are satisfied, residual amounts of the contaminants at those environmentally acceptable levels still produce fumes and odors which create a nuisance, primarily due to minute sources of leakage at various transition points between the various components of the asphalt plant as asphalt materials are conveyed therethrough. For example, as processed material is transferred from a dryer/mixer to a conveyor, from a conveyor to a batcher, from a batcher to a silo, or from a silo to a truck for transportation to a construction site, odors escape into the ambient atmosphere. A major source of the release of these nuisance odors to the atmosphere at the transition points arises from the failure to provide for the displacement of air and other gases and vapors within the various components of the plant to make way for the solids being transferred, and/or failure to provide for fluid filling of a void being created behind such solids during such transfer. As a result of the nuisance created by the leakage of the fumes and odors, even though at environmentally acceptable levels, the placement of an asphalt plant relative to other activities and developments in the surrounding area is sometimes very limited.

What is needed is a gas containment system which provides for displacement of air and other gases and vapors during transfer of asphalt material within an asphalt plant in such a manner that such air and other gases and vapors are prevented from escaping into the surrounding atmosphere and, further, to provide a fluid source for filling voids created behind the asphalt material as it is being transferred with such air and other gases and vapors.

SUMMARY OF THE INVENTION

An improved asphalt plant with a gas containment system is provided for containing noxious and nuisance gases and fumes generated therein from inadvertently escaping into the ambient atmosphere. The gas containment system includes a substantially air tight casing encircling a slat conveyor of the plant, a substantially air tight elevator chute, a substantially air tight batcher chute, and a bypass duct. The elevator chute has substantially air tight connections to each of the drum dryer/mixer and the casing. The batcher chute has substantially air tight connections to each of the casing and the batcher. The batcher has a substantially air tight connection to the silo. The bypass duct is arranged such that, as asphalt material processed by the drum dryer/mixer is contained in the batcher, air and other gases and vapors can freely move between the air space above asphalt material in the batcher and the air space above asphalt material in the silo. The various, substantially air tight components are all interconnected whereby the negative pressure in the drum dryer/mixer is substantially distributed throughout those components, causing substantially all of the noxious and nuisance odors and fumes arising from asphalt material being conveyed through those components to be drawn back to the drum dryer/mixer and processed and treated along with the noxious and nuisance odors generating by the processing which occurs within the drum dryer/mixer. As a result, the noxious and nuisance odors and fumes are prevented from escaping directly into the ambient atmosphere.

Principal Objects and Advantages of the Invention

The principal objects and advantages of the present invention include: providing an asphalt plant that minimizes or eliminates unintentional release of noxious and nuisance fumes and odors into the atmosphere; providing such an asphalt plant that redistributes air and other gases and vapors contained within the asphalt plant to fill voids created within the asphalt plant that result from removal of asphalt material from the asphalt plant; providing such an asphalt plant that redistributes air and other gases and vapors contained within the asphalt plant to fill voids created within the asphalt plant while displacing asphalt material from one compartment of the asphalt plant to another compartment thereof; providing such an asphalt plant wherein direct communication of air and other gases and vapors contained within the asphalt plant with ambient atmosphere surrounding the asphalt plant is substantially eliminated; providing a gas containment system for such an asphalt plant that minimizes or eliminates blue smoke that inadvertently escapes while producing asphalt material in the asphalt plant; providing such a gas containment system for such an asphalt plant wherein the plant is operated in either a parallel flow configuration or a counter flow configuration; providing such a gas containment system for such an asphalt plant wherein the plant is operated in either a continuous mode or a batch mode; providing such a gas containment system for such an asphalt plant wherein the plant is operated either with or without processing RAP material therein; and generally providing such a plant and gas containment system that are reliable in performance, and are particularly well adapted for the proposed usages thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
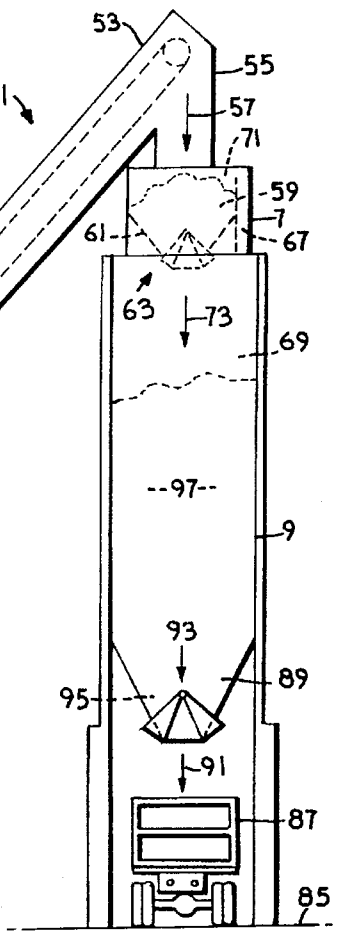
FIG. 1 is a schematic drawing of a gas containment system for an asphalt plant having a counter flow configuration, according to the present invention.
Figure 3:
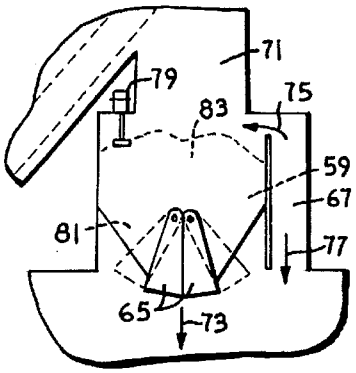
FIG. 3 is an enlarged and fragmentary, schematic drawing of a batcher and bypass duct for the gas containment system for an asphalt, according to the present invention.
Figure 2:
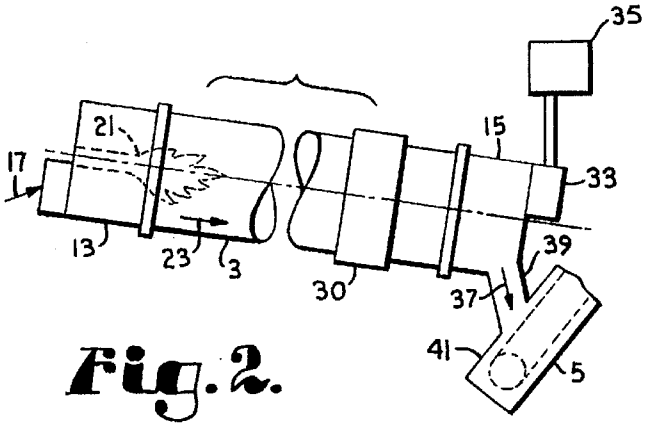
FIG. 2 is a schematic and fragmentary drawing of the gas containment system but showing an asphalt plant having a parallel flow configuration.

The reference numeral 1 generally refers to an asphalt plant with a gas containment system in accordance with the present invention, as shown in FIGS. 1 through 3. The system 1 generally includes drying and mixing means, such as a drum 3, for drying aggregates and/or mixing them with a liquid asphalt composition, such as a drum 3; conveying means such as an elevator 5; batching means such as a batcher 7; storage means such as a silo 9; and gas containment means 11.

The drum 3 is generally cylindrically shaped with an input end 13 inclined and elevated relative to an output end 15 thereof such that aggregate material introduced into and being processed within the drum 3, as indicated by the arrow designated by the numeral 17 in FIG. 1, is gravitationally urged from the input end 13 to the output end 15 as the drum 3 is rotated about a longitudinal axis 19. It is to be understood that the drying/mixing means 3 can be operated in a variety of configurations, including parallel flow as shown in FIG. 2, or counter flow as shown in FIG. 1, and remain within the nature and scope contemplated by the present invention. It is to be further understood that the plant 1 can be operated in either a continuous mode or a batch mode and remain within the nature and scope contemplated by the present invention.

A burner 21 is disposed generally axially within the drum 3 such that hot gases generated thereby, as indicated by the arrow designated by the numeral 23 in FIG. 1, are used to dry and/or heat the materials being processed within the drum 3. The orientation of the burner 21 depends on whether the system is being operated in a parallel flow configuration or a counter flow configuration, with the example shown in FIG. 2 being consistent with a parallel flow operation and in FIG. 1 being consistent with a counter flow operation.

As rock aggregate 17 is introduced into the input end 13 of the drum 3, vane means, such as various types of flights 25 connected to an inner surface of the rotating drum 3, lift and drop the aggregate through the hot gases 23 in a drying zone 26 of the drum 3. As well known by those in the art, when asphalt is heated to a sufficiently high temperature, "blue smoke" or other atmospheric contaminants may be undesirably produced. Thus, after the aggregate 17 is appropriately dried and heated, liquid asphalt composition and other materials are added thereto, as indicated by an arrow designated by the numeral 27 in FIG. 1, in a mixing zone 29 intermediate to the input end 13 and the output end 15 of the drum 3 as the aggregate 17 moves downstream in the drum 3, the liquid asphalt composition 27 being mixed in selected proportions known by those having skill in the art to produce the asphalt mix as desired for its intended purpose. Thus, the liquid asphalt composition 27 is added to the aggregate 17 in the mixing zone 29 remote or isolated from the drying zone 26 of the drum 3 in order to avoid exposing the liquid asphalt composition 27 to the higher, contaminant-causing temperatures of the drying zone 26.

In many applications, recycle asphalt paving ("RAP") is mixed with the heated dry aggregate 17 and liquid asphalt 27 to take advantage of the economy normally provided by utilizing RAP. Thus, RAP, if used, which also contains asphalt from its earlier paving use, is generally added to the aggregate 17 within the mixing zone 29 of the drum 3, such as in conjunction with a RAP collar 30 or by other methods known in the art, to avoid exposure to the higher, contaminant-causing temperatures of the drying zone 26 of the drum 3, as indicated by an arrow designated by the numeral 31 in FIG. 1.

The hot gases 23 generated by the burner 21 are generally exhausted either at the input end 13 of the drum 3 for counter flow operations, or at the output end 15 of the drum 3 for parallel flow operations. Power exhaust means 33 assist in removing the hot gases 23 from the drum 3 and in conveying the gases 23 to other equipment 35 for removal of airborne contaminants therefrom, such as a baghouse, wet scrubber systems, etc. As a result of the exhausting provided by the power exhaust means 33, the pressure within the drum 3 is generally negative relative to the ambient atmospheric pressure surrounding the drum 3. As a result, blue smoke and other contaminants included in the hot gases 23 are generally prevented from otherwise escaping from the drum 3 and are, therefore, conveyed by the power exhaust means 33 to the equipment 35 for further processing, thereby eliminating inadvertent contamination of the atmosphere outside the drum with noxious, contaminating and nuisance odors through the various entrance and exit stations or ports of the drum 3.

After completion of the processing of the asphalt material 17 in the drum 3, the asphalt material 17 is discharged from the drum 3 from the output end 15, as indicated by a arrow designated by the numeral 37 in FIG. 1. If the plant 1 is being operated in a continuous mode, the material 37 is a finished paving mix, ready for use. If, however, the plant 1 is being operated in a batch mode, the material 37 may be ready for storage and further processing as needed.

The material 37 is discharged from the drum 3 through an elevator chute 39 and into an input end 41 of the elevator 5. The gas containment means 11 of the present invention includes the elevator chute 39 being connected substantially air tight to both the output end 15 of the drum 3 and the input end 41 of the elevator 5 such that air and other gases and vapors contained inside the system are prevented from escaping thereabout into the surrounding atmosphere.

The elevator 5 generally includes a slat conveyor 43 that is adapted to receive the asphalt material 37 from the drum 3, and transport and sufficiently elevate the asphalt material 37 such that the asphalt material 37 can be gravitational deposited into the batcher 7. The elevator 5 includes a casing 45 that is also substantially air tight. Normally, an upper run 47 of the slat conveyor 43 transports the asphalt material 37 longitudinally therealong, while a lower run 49 provides a return for the slat conveyor 43. Except for a chain and flights and related components comprising the upper and lower runs, 47 and 49, and the asphalt material 37 conveyed thereby, the interior of the elevator 5 is relatively open such that air and other gases and vapors contained within the elevator 5 can freely flow either from the batcher 7 to the drum 3, or from the drum 3 to the batcher 7, as indicated by a double arrow designated by the numeral 51 in FIG. 1.

As the asphalt material 37 gravitationally tumbles from an upper, output end 53 of the elevator 5, the material 37 drops through a batcher chute 55 into the batcher 7, as indicated by an arrow designated by the numeral 57 in FIG. 1, to join material 59 already contained in the batcher 7. The maximum vertical height that the asphalt material 37 drops from the slat conveyor 53 into the batcher 7 is arranged such that segregation of the asphalt material 37 into its various constituents is largely or entirely eliminated. The batcher chute 55 is connected to both the output end 53 of the elevator 5 and the batcher 7 in an air tight arrangement such that, once again, air and other gases and vapors inside the system are prevented from escaping thereabout into the surrounding atmosphere.

The batcher 7 comprises a lower, downwardly convergent, generally frusto-conical portion 61 that includes gate means 63, such as a pair of oppositely acting gates 65. It is to be understood that other gating arrangements may be equally suitable, including a single gate that moves to one side allowing the asphalt material 59 contained in the batcher 7 to gravitationally empty into the underlying silo 9. The batcher 7 includes a bypass duct 67 along one side thereof such that a silo air space 69 below the batcher 7 freely communicates with a batcher air space 71 above the asphalt material 59 contained in the batcher 7. As before, the batcher 7 is connected in an air tight arrangement to the silo 9 such that air and other gases and vapors passing directly between the silo 9 and the batcher 7, other than those contained within the asphalt material 59 falling from the batcher 7 into the silo 9, as indicated by an arrow designated by the numeral 73 in FIG. 2, must pass through the bypass duct 67. It is to be understood that air and other gases and vapors may freely pass through the bypass duct 67 in either direction, namely from the silo 9 to the batcher 7, as indicated by an arrow designated by the numeral 75 in FIG. 3, and from the batcher 7 to the silo 9, as indicated by an arrow designated by the numeral 77 in FIG. 3.

The batcher 7 generally includes a level indicator 79 that indicates that the level of the asphalt material 59 contained in the batcher 7 has reached a certain selected condition, such as "full". If desired, the "full" signal may be arranged to automatically open the batcher gate means 63 and gravitationally empty some or all of the asphalt material 59 into the underlying silo 9. Preferably, only a portion of the material 59 will fall from the batcher 7 into the silo 9, leaving the remainder in the batcher 7 to serve as a barrier to passage of air and other gases and vapors between the batcher 7 and the silo 9 through the gate means 63.

As a lowermost portion 81 of the asphalt material 59 in the batcher 7 passes through the opened gate means 63 and into the silo air space 69, the air and other gases and vapors displaced by the asphalt material 73 entering the silo air space 69 passes upward through the bypass duct 67 to fill the void created by an upper portion 83 of the asphalt material 59 in the batcher 7, as the upper portion 83 moves downward to replace the asphalt material 73 that fell into the silo 9.

The silo 9 is spaced a sufficient distance above an underlying surface 85 such that a truck 87 can be driven therebeneath to receive asphalt material, as indicated by an arrow designated by the numeral 91, through a lower, downwardly convergent, generally frusto-conical portion 89 of the silo 9. Silo gate means 93 serve as an asphalt mix flow control gate and allow the asphalt material 91 to be selectively loaded into the truck 87. As the silo gate means 93 are opened, a lowermost portion 95 of asphalt material 97 contained in the silo 9 passes through the silo gate means 93 and into the underlying truck 87. The asphalt material 97 in the silo 9 above the lowermost portion 95 then moves downwardly to replace the lowermost portion 95 that exited the silo 9.

As hereinbefore described wherein a portion of the material 59 is preferably retained in the batcher 7 to serve as a barrier, the asphalt material 97 above the lowermost portion 95 also serves as a barrier to prevent air and other gases and vapors above the asphalt material 97 from freely communicating with the ambient atmosphere lying outside the silo gate means 93. As a result, as the asphalt material 91 flows from the silo 9 into the underlying truck 87, air and other gases and vapors contained in the batcher air space 71 are drawn downwardly through the bypass duct 67 to fill a void created by the asphalt material 91 being deposited in the underlying truck 87. The silo 9 generally has sufficient volume whereby a plurality of the trucks 87 can be loaded in relatively rapid sequence or simultaneously.

In an application of the present invention, a negative pressure is created in the drum 3 by the power exhaust means 33, which exists to a greater or lesser extent throughout the asphalt plant 1, as the aggregate 17 is processed through the drum 3. As a result, air and other gases and vapors within the drum 3 are fed from air and other gases and vapors contained throughout the interior of the asphalt plant 1. If the silo 9 is empty, ambient atmosphere flows through the silo gates means 93 into the silo 9 which, in turn, flows from the silo air space 69 into the batcher air space 71 through the bypass duct 67 and, if empty, through the gate means 63 which, in turn, flows through the elevator 5 which, in turn, flows through the drum 3 and into the power exhaust means 33. If the flow of the asphalt material 37 through the elevator chute 39 overly inhibits the flow of air and other vases and vapors through the elevator chute 39 into the drum 3, a booster fan 99, shown in phantom lines in FIG. 1, may be utilized to draw air and other gases and vapors from the elevator 5 and exhaust them into the drum 3, as indicated schematically by the arrow designated by the numeral 100, to thereby maintain the negative pressure within the elevator 5, etc., relative to the ambient atmosphere.

As the asphalt material 37 leaves the drum 3 and progresses along the elevator 5, the negative pressure in the drum 3 and throughout the plant 1 is maintained, preventing air and other gases and vapors, including those arising from the asphalt material 37 traveling along the slat conveyor 43, from escaping into the ambient atmosphere. As the asphalt material 57 falls from the slat conveyor 43 into the batcher 7, that asphalt material 59 is temporarily trapped in the batcher 7 by the closed batcher gate means 63. As a result, air and other gases and vapors are prevented from flowing from the silo air space 69 into the batcher air space 71, except through the bypass duct 67. However, a negative pressure is still maintained in the silo air space 69 by flow of air and other gases and vapors from the silo air space 69 to the batcher air space 71 through the bypass duct 67. As asphalt material 37 continues to leave the drum 3 and take up residence in the batcher 7 or silo 9, air and other gases and vapors contained in the batcher 7 and silo 9 tend to be transported toward the drum 3 through the elevator 5 to make room for the newly arriving asphalt material.

After the asphalt material 59 has filled sufficiently to cause the level indicator 79 to trigger opening of the batcher gate means 63, some of the material 59 drops into the silo 9, as the asphalt material 97. Again, the asphalt material 97 is temporarily trapped, this time in the silo 9 by the closed silo gate means 93. As a result, air and other gases and vapors are largely or entirely prevented from flowing through the silo gate means 93 into the silo 9 from the ambient atmosphere. Even so, a negative pressure is still maintained in the silo air space 69 as a result of flow communication between the silo air apace 69 and the drum 3 through the elevator 5.

As each consecutive batch of the asphalt material 73 is released by the batcher 7 to the silo 9, air and other gases and vapors displaced thereby from the silo air space 69 flow through the bypass duct 67 and fill the corresponding void created in the batcher 7. Such release of a batch of the asphalt material 73 from the batcher 7 to the silo causes minimal, if any, shift of air and other gases and vapors along the elevator 5.

When, however, the asphalt material 91 is released into the underlying truck 87, a void tends to be created above the asphalt material 97 remaining in the silo 9. As the asphalt material 97 blocks entry of ambient atmosphere into the silo 9 through the silo gate means 93 and thereby prevents direct flow communication between the ambient atmosphere and the air and other gases and vapors contained in the silo air space 69, release of obnoxious and nuisance fumes and odors into the atmosphere, other than those newly arising from the asphalt material 91 loaded on the truck 87, is substantially prevented. The air and other gases and vapors needed to fill the void created by the asphalt material 91 loaded on the truck 87 flows from the drum 3, through the elevator 5 and the bypass duct 67, and into the silo air space 69.

It is to be understood that while certain forms of the present invention have been illustrated and described herein, it is not to be limited to the specific forms or arrangement of parts described and shown.

What is claimed and desired to be secured by Letters Patent is as follows:

1. An asphalt plant for processing asphalt material from various ingredients, said plant comprising:

(a) a rotating drum configured to receive and process the various ingredients such that the asphalt material is discharged therefrom;

(b) an elevator configured to receive the asphalt material discharged by said rotating drum and to discharge the asphalt material therefrom;

(c) a batcher configured to receive the asphalt material discharged by said elevator and to discharge the asphalt material therefrom;

(d) a silo configured to receive the asphalt material discharged by said batcher and to discharge the asphalt material therefrom;

(e) a power exhaust configured to exhaust air and other gases and vapors from said rotating drum and to create a negative pressure relative to ambient atmospheric pressure within said rotating drum; and (f) gas containment means for operably preventing leakage of air and other gases and vapors contained within said plant with ambient atmosphere surrounding said plant and for operably distributing said negative pressure throughout said plant.

2. The asphalt plant according to claim 1, wherein said gas containment means include:

(a) a substantially air tight encasement encircling said elevator; and (b) an elevator chute having a substantially air tight connection to each of said drum and said encasement.

3. The asphalt plant according to claim 1, wherein said gas containment means include:

(a) a substantially air tight encasement encircling said elevator; and (b) a batcher chute having a substantially air tight connection to each of said batcher and said encasement.

4. The asphalt plant according to claim 3, including:

(a) a substantially air tight seal connecting said batcher to said silo; and (b) a bypass duct interconnecting said batcher and said silo, wherein said bypass duct is configured to route air and other gases and vapors from said silo to said batcher as said silo is receiving the asphalt material being discharged from said batcher.

5. The asphalt plant according to claim 1 wherein said gas containment means includes a substantially air tight encasement encircling said elevator providing a substantially air tight connection to each of said drum and said batcher.

6. The asphalt plant according to claim 1 wherein said gas containment means includes a substantially air tight encasement encircling said elevator providing a substantially air tight connection to each of said drum and said silo.

7. The asphalt plant according to claim 1, wherein said power exhaust is connected to said drum such that said drum has a parallel flow configuration, wherein the direction of flow of air and other gases and vapors contained in said drum is the same as the direction of flow of materials being processed by said drum.

8. The asphalt plant according to claim 1, wherein said power exhaust is connected to said drum such that said drum has a counter flow configuration, wherein the direction of flow of air and other gases and vapors contained in said drum is opposite to the direction of flow of materials being processed by said drum.

9. The asphalt plant according to claim 1, wherein said plant includes a collar attached to said drum for introducing recycle asphalt paving as an ingredient of the asphalt material.

10. A gas containment system for an asphalt plant for processing asphalt material wherein the asphalt plant various components including has a drum mixer/dryer, a conveyor, a batcher, a silo, and a power exhaust connected to said drum for creating a negative pressure in the drum mixer/dryer relative to ambient atmospheric pressure, said gas containment system comprising:

(a) a substantially air tight casing encircling the conveyor; and (b) a substantially air tight elevator chute providing a substantially air tight connection with each of the drum dryer/mixer and said casing such that the power exhaust also creates a negative pressure, relative to ambient atmospheric pressure, in said casing.

11. The gas containment system according to claim 10, including a blower connected to the drum dryer/mixer and said casing, said blower assisting said elevator chute to maintain said negative pressure relative to abient atmospheric pressure in said casing.

12. The gas containment system according to claim 10, including a substantially air tight batcher chute providing a substantially air tight connection with each of the batcher and said casing such that the power exhaust also creates a negative pressure, relative to ambient atmospheric pressure, in the batcher.

13. The gas containment system according to claim 12, including a bypass duct interconnecting the batcher and the silo such that said bypass duct, said elevator chute, said casing and said batcher chute cooperatively distribute the negative pressure created within the drum dryer/mixer to the conveyor, the batcher and the silo.

14. The gas containment system according to claim 12, including a bypass duct interconnecting the batcher and the silo such that the power exhaust also creates a negative pressure, relative to ambient atmospheric pressure, in the silo.

15. The gas containment system according to claim 14, wherein said bypass duct distributes air an other gases and vapors being displaced by an asphalt material being conveyed from the batcher into the silo to a void created in the batcher by the asphalt material as it is conveyed from said batcher to said silo.

16. The gas containment system according to claim 14, wherein said bypass duct distributes air and other gases and vapors from the batcher to the silo to fill a void created in the silo as the asphalt material is being conveyed from said batcher to said silo such that negative pressure, relative to ambient atmospheric pressure, is maintained in both the batcher and the silo.

17. An asphalt plant for processing asphalt material, comprising:

(a) a rotating drum;

(b) a batcher configured to contain the asphalt material, said batcher having gate means for selectively and gravitationally releasing the asphalt material from said batcher;

(c) an elevator configured to convey the asphalt material from said drum to said batcher;

(d) a silo spaced beneath said batcher such that the asphalt material released by said gate means is received therein;

(e) a power exhaust connected to said drum for exhausting air and gases and vapors from said drum; and (f) gas containment means for operably preventing leakage of air and other gases and vapors contained within said drum, said elevator, said batcher, and said silo with ambient atmosphere surrounding said plant, said gas containment means including:

(1) a substantially air tight encasement encircling said elevator, (2) an elevator chute having a substantially air tight connection to each of said drum and said encasement, (3) a batcher chute having a substantially air tight connection to each of said batcher and said encasement, (4) a substantially air tight seal connecting said batcher to said silo, and (5) a bypass duct between said batcher and silo configured to route air and other gases and vapors from said silo to above an asphalt material contained in said batcher as said gate means releases said asphalt material into said silo.

18. In an asphalt plant for processing asphalt material wherein the asphalt plant includes a drum dryer/mixer, a slat conveyor, a batcher, a silo and a power exhaust connected to said drum dryer/mixer for creating a negative pressure in the drum mixer/dryer relative to ambient atmospheric pressure, wherein the improvement comprises a gas containment system comprising:

(a) a casing encircling the slat conveyor and providing a substantially air tight enclosure thereabout;

(b) a substantially air tight elevator chute configured to receive the asphalt material therethrough and to provide a substantially air tight connection with each of the drum dryer/mixer and said casing;

(c) a substantially air tight batcher chute configured to receive the asphalt material therethrough and to provide a substantially air tight connection with teach of the batcher and said casing; and (d) a bypass duct between said batcher and silo for distributing air and other gases and vapors being displaced by an asphalt material being conveyed from the batcher into the silo to a void in said batcher created by asphalt material as it is conveyed from said batcher to said silo.

19. The improvement according to claim 18, wherein said elevator chute, said casing, and said batcher chute substantially distribute the negative pressure within the drum dryer/mixer to the elevator, the batcher and the silo.

20. The improvement according to claim 18, wherein said casing, said elevator chute, said batcher chute, and said bypass duct interconnect the drum, the batcher and the silo components of the asphalt plant such that, as the asphalt material being processed by the plant is conveyed from one of said components to another, a release of noxious and nuisance fumes and odors from between said components into the atmosphere is substantially eliminated.

21. The improvement according to claim 20, wherein said casing, said elevator chute, said batcher chute, and said bypass chute interconnect the drum, the batcher, and the silo, such that, as the asphalt is being removed form the plant, the release of noxious an nuisance fume and odors from the silo into the atmosphere is also substantially eliminated.

* * * * *

UNITED STATES PATENT AND TRADEMARK OFFICE

CERTIFICATE OF CORRECTION

PATENT NO. : 5,634,712

DATED : June 3, 1997

INVENTOR(S) : Joseph E. Musil

It is certified that error appears in the above-indentified patent and that said Letters Patent is hereby corrected as shown below:

In Column 8, line 29: After "plant" and before "various", insert --has-- .

In Column 8, line 30: delete "has" .

Signed and Sealed this

Seventeenth Day of February, 1998

Bruce Lehman

*Attest:*

BRUCE LEHMAN

*Attesting Officer*

*Commissioner of Patents and Trademarks*